United States Patent [19]

Robinet

[11] 4,015,441

[45] Apr. 5, 1977

[54] REFRIGERATION APPARATUS

[76] Inventor: Sylvia J. Robinet, 404, 6505 Huntridge Hill, NW., Calgary, Alberta, Canada, T2K 5E5

[22] Filed: Mar. 10, 1976

[21] Appl. No.: 665,531

[52] U.S. Cl. ..... 62/402; 418/13

[51] Int. Cl.[2] ..... F25D 9/00; F01C 1/30; F01C 11/00; F03C 3/00

[58] Field of Search ..... 62/402; 418/13; 417/406

[56] References Cited

UNITED STATES PATENTS

| | | | |
|---|---|---|---|
| 1,940,384 | 12/1933 | Zoller | 418/13 |
| 2,915,017 | 12/1959 | Whitney | 418/13 |
| 3,686,893 | 8/1972 | Edwards | 62/402 |
| 3,884,664 | 5/1975 | Edwards | 62/402 |

*Primary Examiner*—Lloyd L. King
*Attorney, Agent, or Firm*—Finnegan, Henderson, Farabow & Garrett

[57] ABSTRACT

Disclosed is a first stator defining an internal cavity and a second stator within the cavity of the first stator. A cylindrical rotor is disposed within the cavity. The rotor defines a first chamber within the cavity between it and the inner walls of the first stator and a second chamber within the cavity between the rotor and the outer walls of the second stator. The rotor carries vanes radially slidable in slots spaced circumferentially about the rotor. The inner and outer walls of the first and second stators respectively are spaced one from the other such that the linear distance therebetween along any extended radius of the rotor is substantially equal to the radial length of vanes whereby the outer and inner edges of the vanes are in continuous engagement along the inner and outer walls of the respective first and second stators upon rotation of the rotor. An inlet and an outlet are provided each of the first and second chambers. Air flowing into the second chamber is compressed upon rotation of the rotor and flows to a heat exchanger. Cool compressed air flows from the heat exchanger to the first chamber where it is expanded and further cooled for delivery to a cooling duct.

11 Claims, 3 Drawing Figures

10
12
14
16
18
20
22
24
26
30
32
34
36
38
40
42
44
46
48
50
52
56
57
58
59
60
61
63
65
100
102
104
108
110
112
114
116
120
122
130
132
134
136
A
B
12a
14a
16a
18a
32a
34a

REFRIGERATION APPARATUS

The present invention relates to refrigeration apparatus and particularly relates to refrigeration apparatus having novel and improved construction in comparison with prior refrigeration apparatus disclosed in U.S. Pat. No. 3,686,893.

In prior U.S. Pat. No. 3,686,893, there is disclosed a refrigeration device including a rotor disposed in an elliptical chamber. The rotor has a plurality of radially extending slots. Vanes are slidably disposed in the slots for movement such that, upon rotation of the rotor, the outer edges of the vanes are maintained in engagement along the inner wall of the elliptical cavity. Air admitted into one side of the elliptical cavity is first compressed and delivered to a heat exchanger for further cooling. The compressed cooled air is delivered to the opposite side of the elliptical cavity and expanded whereby the air is further cooled and delivered to an outlet.

It will be appreciated that the refrigeration device of U.S. Pat. No. 3,686,893 requires expansion and compression chambers on opposite sides of the rotor. This necessarily and undesirably increases the size of the overall device and inhibits its use in many applications.

Accordingly, it is a primary object of the present invention to provide a novel and improved refrigeration apparatus having various advantages in construction, mode of operation and result in comparison with prior refrigeration devices including the refrigeration device disclosed in prior U.S. Pat. No. 3,868,893.

It is another object of the present invention to provide a novel and improved refrigeration device which is compact in size and affords high refrigeration or cooling capacity for its size.

It is still another object of the present invention to provide a novel and improved refrigeration device having shaped stator surfaces and a rotor with radially slidable vanes wherein each rotor vane cooperates with such surfaces to simultaneously compress and expand air in separate chambers respectively within and without the rotor as the vanes rotate with the rotor.

It is a further object of the present invention to provide a novel and improved refrigeration apparatus wherein the refrigeration capacity is substantially increased without significant increase in the overall size of the device in comparison with the size of comparable prior refrigeration devices, for example the device disclosed in prior U.S. Pat. No. 3,686,893.

To achieve the foregoing objects and in accordance with the present invention, as embodied and broadly described herein, the refrigeration apparatus hereof comprises a first stator having an inner wall defining a cavity noncircular in cross section. A second stator is disposed within the cavity and has outer walls spaced from the inner walls of the first stator. A rotor comprising a sleeve is disposed within the cavity and about the second stator for rotation about a fixed axis. The rotor defines a first chamber within the cavity between the sleeve and the inner wall of the first stator and a second chamber within the cavity between the sleeve and the outer wall of the second stator. The rotor sleeve has a plurality of circumferentially spaced, axially elongated, slots. A plurality of vanes are carried by the rotor for sliding movement in the slots along respective radii of the sleeve. The vanes are equal in length between their respective radially inner and outer edges. The inner and outer walls of the stators are spaced one from the other such that the linear distance therebetween along any radius from the axis of rotation of the rotor is substantially equal to the radial length of the vanes, whereby the outer and inner edges of the vanes are maintained in substantially continuous engagement along the inner and outer walls of the first and second stators respectively upon rotation of the rotor. An inlet is carried by the second stator for discharging air into the second chamber. An outlet is carried by the second stator in communication with the second chamber for removing air compressed in the second chamber upon rotation of the rotor. A heat exchanger is connected to the outlet for cooling the compressed air received from the second chamber. An inlet is connected to the heat exchanger for admitting air from the heat exchanger to the first chamber. An outlet is carried by the first stator in communication with the first chamber for delivering air expanded and cooled in the first chamber upon rotation of the rotor.

In accordance with another form of the present invention, the capacity of the refrigeration apparatus can be effectively increased by shaping the first and second stators to provide third and fourth chambers respectively defined between the rotor and the inner wall of the first stator and the rotor and the outer wall of the second stator and on the opposite side of the first stator from the first chamber. Thus, each of the compression and expansion portions of the cycle may take place over less than 180° of rotation of the rotor.

The invention consists in the novel parts, constructions, arrangements, combinations and improvements shown and described. The accompanying drawings, which are incorporated in and constitute a part of the specification, illustrate two embodiments of the invention and, together with the description, serve to explain the principles of the invention.

Figures 1, 2, 3:
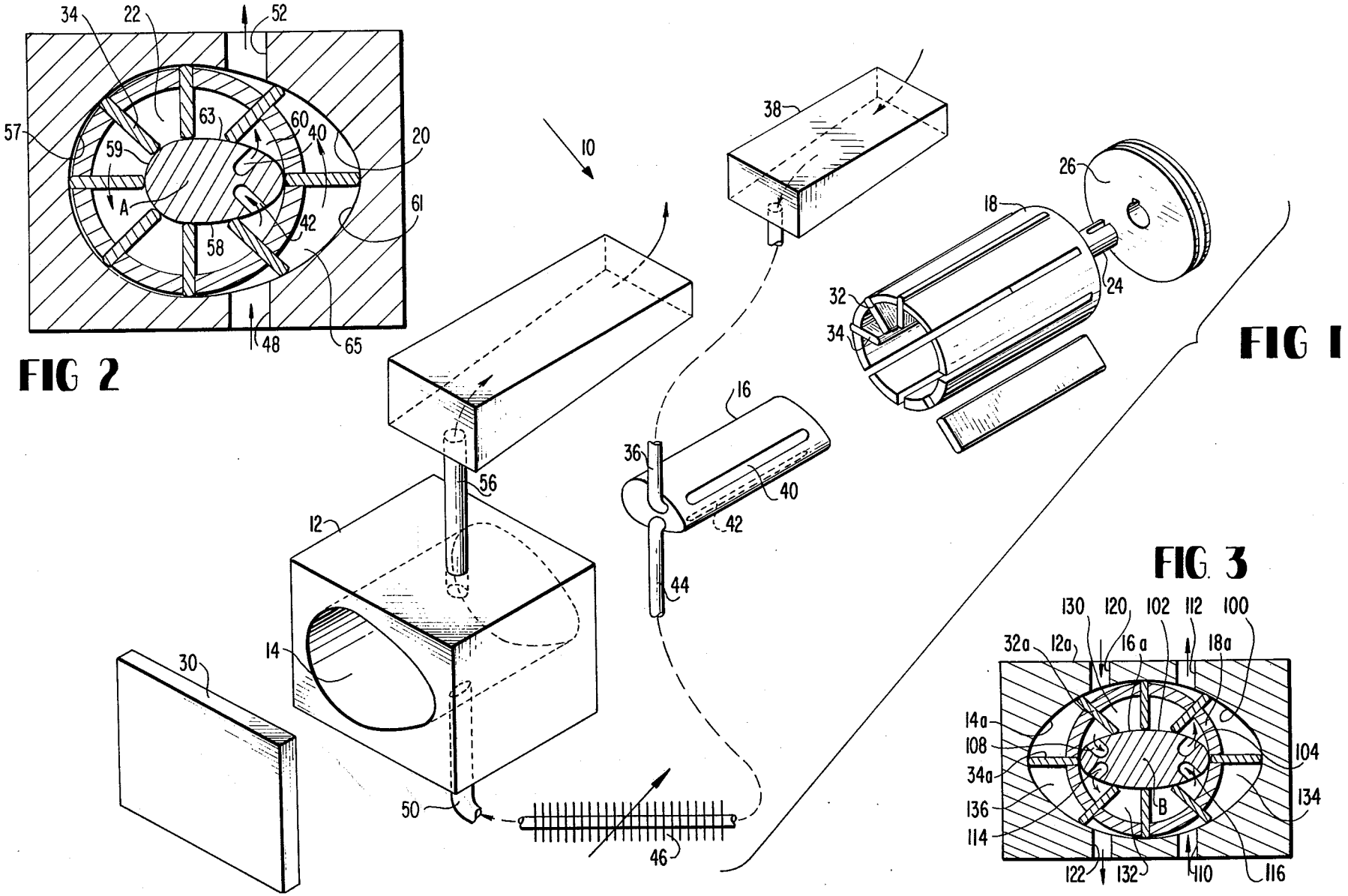
FIG. 1 is an exploded perspective view of various elements forming one embodiment of the present invention.
FIG. 2 is an enlarged cross-sectional view through the first and second stators taken normal to the axis of rotation of the rotor illustrated between the first and second stators.
FIG. 3 is a view similar to FIG. 2 and illustrating a further embodiment of the present invention.

Referring now to the drawings and particularly to FIGS. 1 and 2, there is illustrated a refrigeration apparatus, generally designated 10, constructed in accordance with the present invention and including an external or first stator 12 defining an internal cavity 14 and an internal or second stator 16 disposed within cavity 14. Also disposed within the cavity 14 about stator 16 is a rotor 18 comprising a cylindrical sleeve open at one end. Rotor 18 is provided at its opposite end with an end wall 22 from which projects a stub shaft 24. Shaft 24 is suitably journalled in bearings provided in an end wall plate, not shown, and which plate closes one end of cavity 14 of stator 12. Seals, not shown, are also provided about shaft 24 in the end plate. Shaft 24 carries a pulley 26 which is attached through suitable banding, not shown, to a power source, also not shown, whereby sleeve 18 is rotated within cavity 14 about its axis designated A in FIG. 2. The opposite end of stator 12 is provided with an end closure plate 30 which seals the opposite end of cavity 14. The end of rotor 18 remote from shaft 24 bears in rotatable sealing relation against end plate 30 whereby the interior of rotor 18 is sealed at plate 30 from the portion of cavity 14 external to rotor 18.

Rotor 18 is provided with a plurality of elongated axially extending circumferentially spaced slots 32. Preferably slots 32 are equally circumferentially spaced one from the other about rotor 18. Slots 32 serve as guides for vanes 34 which are received within the slots for radial sliding movement. Vanes 34 extend substantially the entire axial length of rotor 18 and have equal radial extent between their elongated inner and outer edges.

Internal stator 16 is suitably secured at one end to end plate 30 when disposed in cavity 14. The opposite end of stator 16 seals against the end wall 22 of rotor 18. An inlet conduit 36 lies in communication at one end with an inlet duct 38 and at its opposite end with an elongated slot or inlet 40 formed in the outer wall of stator 16 whereby warm air is received through duct 38 and conduit 36 for flow through elongated slot 40 into the chamber 60 defined between stator 16 and rotor 18. Stator 16 is also provided with an elongated outlet slot 42 in communication with a conduit 44 for transmitting compressed air to a heat exchanger 46. An inlet 48 is provided one side of cavity 14 and lies in communication through a conduit 50 with heat exchanger 46. The opposite side of cavity 14 is provided with an outlet 52 in communication through a conduit 56 with an outlet duct 54. As best illustrated in FIG. 2, the wall 20 defining cavity 14 and stator 16 are, in cross section, generally egg-shaped. The left-hand surface 57 of the wall 20 defining cavity 14 and the corresponding left-hand surface 59 of the outer wall 58 of stator 16, as illustrated in FIG. 2, are semi-circular and substantially concentric one with the other. When the device hereof is assembled, rotor 18 is disposed externally about stator 16 and within cavity 14 with its axis of rotation A lying substantially coincident with the center of the semi-circular wall surfaces 57 and 59. Vanes 34 extend radially between the semi-circular substantially concentric surface 59 of stator 16 and the inner surface 57 of stator 12. The inner and outer edges of vanes 34 lie in sealing relationship with surfaces 59 and 57, respectively.

The right-hand surface 61 of cavity wall 20 of stator 12 and the corresponding right-hand surface 63 of wall 58 of stator 16 are shaped and spaced one from the other such that the linear distance between such surfaces along any extended radius from the axis of rotation A of rotor 18 is substantially equal to the radial length of the vanes. Such surfaces 61 and 63 may be characterized as substantially semi-ellipsoidal. Thus, as rotor 18 rotates within cavity 14, the vanes 34 slide outwardly and inwardly along guide slots 32 and along radii of the rotor. Thus, upon rotation of rotor 18, the inner and outer edges of the vanes are maintained in continuous sealing engagement along the wall surface 63 of stator 16 and inner wall surface 61 of stator 12, respectively.

It will be appreciated that the vanes slide radially with respect to rotor 18 during their rotary excursion only when they engage the substantially semi-ellipsoidal surfaces 63 and 61 and do not slide at all when they bear against semi-circular surfaces 57 and 59. Throughout the rotary excursion of the vanes, their inner and outer edges at all times bear in sealing relation to the outer and inner surfaces 58 and 20 of the second and first stators respectively.

In operation, warm incoming air flows through duct 38 and conduit 36 for egress through slot 40 into the chamber 60 defined between stator 16 and rotor 18. Upon rotation of rotor 18 in counterclockwise direction as illustrated in FIG. 2, by driving pulley 26 from a suitable power source, not shown, this warm air is carried by vanes 34 about stator 16 in the discrete variable volume compartments defined between adjacent vanes 34, rotor 18, stator 16, end plates 30 and the opposite end wall 22 of rotor 18. It will be appreciated that, during such rotation, vanes 34 slide radially within guide slots 32 for that portion of their cycle in which their edges bear against respective surfaces 61 and 63 and at all times maintain their outer and inner edges in sealing contact with the surfaces 20 and 58 respectively. Thus, as rotor 18 rotates, the air within each discrete compartment in chamber 60 is compressed until such compartment lies in communication with outlet 42 of stator 16. This compressed air flows through conduit 44 to heat exchanger 46 where the air is cooled. The cooled air from heat exchanger 46 is directed back to the device via conduit 50 and inlet port 48 into the chamber 65 defined between rotor 18 and stator 12. Particularly, this cooled air flows into the discrete compartments within chamber 65 formed between the wall surface 20, the outer surface of rotor 18, adjacent vanes 34, end plate 30, and the opposite end wall 22 of rotor 18. Upon continued rotation of rotor 18, this cooled air is expanded and hence greatly cooled in these discrete compartments as the air is displaced about cavity 14. This highly cooled air egresses from the refrigeration apparatus hereof through an outlet port 52.

Referring now to FIG. 3, there is illustrated a further embodiment of the present invention wherein like or similar parts are designated with like numbers followed by the suffix *a*. In this form, there is provided an external or first stator **12*a* which defines an internal cavity 14*a* and an internal or second stator 16*a* disposed within cavity 14*a*. Also disposed within cavity 14*a* is a rotor 18*a* comprising a cylindrical sleeve having the same configuration and driven by substantially the identical means as the rotor 18 illustrated in the embodiment of FIGS. 1 and 2. That is, rotor 18*a* is provided with a plurality of elongated, axially extending, circumferentially spaced slots 32*a* which serve as guides for vanes 34*a*.**

In this embodiment, however, both the wall surface 100 defining the internal surface of cavity **14*a* and the wall surface 102 defining the external surface of stator 16*a* are, in cross section, substantially ellipsoidal. The major and minor axes of each of the cavity 14*a* defined by wall surface 100 and the wall surface 102 of stator 16*a* intersect along a common, longitudinally extending, axis denoted B. The axis of rotation of rotor 18*a* also coincides with the longitudinal axis B. Similarly as described previously with respect to the substantially semi-ellipsoidal surfaces 61 and 63, these wall surfaces 100 and 102 are shaped and spaced one from the other for the full 360° about axis B such that the linear distance between such surfaces along any radius extending from the axis of rotation B of rotor 18*a* is substantially equal to the radial length of vanes 34*a*. It will be appreciated that the internal diameter of rotor 18*a* is only slightly larger than the length of the major axis of stator 16*a* whereby discrete chambers 130 and 132 are formed between rotor 18*a* and stator 16*a* on opposite sides of the major axis of stator 16*a*. Also, the external diameter of rotor 18***a* is only slightly less than the length of the minor axis of stator cavity 14*a* whereby discrete chambers 134 and 136 are formed between rotor 18*a* and the cavity wall surfaces 100 on opposite sides of the minor axis of cavity 14*a*.

Stator wall surface 102 is provided on one side of its major axis with an inlet port 104 and an outlet port 108. Inlet port 104 is connected to a suitable duct and conduit, not shown, for directing warm air into the device similarly as duct 38 and conduit 36 provide for air flow into the refrigeration device of the prior embodiment. Outlet port 108 is connected to a heat exchanger, not shown, similar to the heat exchanger 46 of the previous embodiment. Outer stator 12*a* is provided, on one side of its minor axis, with an inlet port 110 connected to the heat exchanger, not shown, and an outlet port 112 opposite inlet port 110. Outlet port 112 is connected to suitable ducting for delivery of cooled air as desired.

Stator wall surface 102 is also provided on the opposite side of its major axis with an inlet port 114 and an outlet port 116. Inlet port 114 is connected to a suitable duct and conduit, not shown, for directing warm air into the device. Alternatively, inlet port 114 can be connected to the same duct and conduit as directs warm air into the device through inlet port 104, such warm air being split between inlet ports 104 and 114. Outlet port 116 is connected to a heat exchanger which may be separate or the same as the heat exchanger to which outlet port 108 is connected. Outer stator 12*a* is provided, on the opposite side of its minor axis, with an inlet port 120 connected to such heat exchanger, and an outlet port 122 opposite inlet port 120. Outlet port 122 is connected to suitable ducting for delivery of cooled air as desired.

In operation, air entering the second stator 16*a* via the duct and conduit, not shown, flows into chamber 130 by way of inlet 104. Particularly, this air flows into the discrete variable volume compartments formed between adjacent vanes 34*a*, the wall surfaces of stator 16*a* and rotor 18*a*, the stator end plate, not shown, and the opposite end wall of rotor 18*a*. As rotor 18*a* rotates, this air is compressed and egresses through outlet port 108 in communication with the heat exchanger, not shown. The air is substantially cooled in the heat exchanger and returns via a suitable conduit, not shown, through inlet port 110 and into chamber 134 on one side of the minor axis of the stator and cavity. Particularly, this air flows into the discrete variable volume compartments formed between adjacent vanes 34*a*, the wall surfaces of stator 12*a* and rotor 16*a*, the stator end plate, not shown, and the opposite end wall of rotor 18*a*. The air in these compartments is rapidly expanded as the rotor rotates in a counterclockwise direction as illustrated in FIG. 3 and the cooled air thus exits from port 112 on the opposite side of stator 12*a*.

Likewise, air from the same or a similar duct flows into chamber 132 by way of an inlet 114. This air is conveyed in the discrete compartments defined between adjacent vanes 34*a*, the outer surface 102 of stator 16*a*, the interior wall of rotor 18*a*, the end plate, not shown, and the end wall of rotor 18*a*. As the rotor rotates, air is compressed in these compartments for egress through outlet 116. Outlet 116 communicates the compressed air to a heat exchanger where it is substantially cooled. Cooled air from such heat exchanger is directed by suitable conduits through inlet port 120 in stator 12*a* into chamber 136. This cooled air is conveyed about chamber 136 in the discrete compartments defined between adjacent vanes 34*a*, the inner and outer walls of cavity 14*a* and rotor 18*a* respectively, and the end wall and plate, not shown, for expansion and delivery of substantially cooled air through outlet 122.

It will be appreciated that the major and minor axes of the substantially ellipsoidal cavity defined by the wall surface 100 in the embodiment of FIG. 3 hereof are coincident with the major and minor axes of the second stator 16*a*. In the first embodiment hereof illustrated in FIGS. 1–2, the major and minor axes of the cavity 14 defined by the surface 20 lie substantially coincident with the major and minor axes of stator 16. However, in this form, the minor axes are offset from the median point of the major axes. In both forms, the intersection of the major and minor axes lie substantially coincident with the longitudinal axis of rotation of the corresponding rotor.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. Refrigeration apparatus comprising a first stator having an inner wall defining a cavity, a second stator within said cavity and having an outer wall spaced from the inner wall of said first stator, one of said cavity and said second stator being at least in part non-circular in cross section, a rotor including a sleeve within said cavity and rotatable about a fixed axis, said rotor defining a first chamber within said cavity between said sleeve and the inner wall of said first stator and a second chamber within said cavity between said sleeve and the outer wall of said second stator, said sleeve having a plurality of circumferentially spaced slots, a plurality of vanes carried by said rotor for sliding movement in said slots along respective radii of said sleeve, said vanes being substantially equal in length between their respective radially inner and outer edges, the inner and outer walls of said first and second stators respectively being spaced one from the other such that the linear distance therebetween along any radius from said axis of rotation is substantially equal to the length of said vanes, said vanes being slidable radially, upon rotation of said rotor through at least part of each revolution thereof, whereby the outer and inner edges of said vanes are maintained in substantially continuous engagement with the walls of the first and second stators respectively, an inlet carried by said apparatus for delivering air into said second chamber, an outlet carried by said apparatus in communication with said second chamber, said vanes forming with said sleeve and said second stator a plurality of variable volume working chambers within said second chamber for compressing air delivered thereto and delivering such compressed air to said outlet upon rotation of said rotor, a heat exchanger connected to said outlet for cooling the compressed air received from said second chamber, an inlet connected to said heat exchanger for admitting the cooled air from said heat exchanger into said first chamber, and an outlet carried by said apparatus in communication with said first chamber, said vanes forming with said sleeve and the inner wall of said first stator a plurality of variable volume working chambers within said first chamber for expanding and cooling air admitted thereto and delivering such expanded and cooled air through the latter mentioned outlet upon rotation of said rotor.

2. Apparatus according to claim 1 wherein the surfaces defining the inner wall of said first stator and the outer wall of said second stator are each in part substantially semicircular in cross section, said rotor being substantially concentric with said semicircular inner and outer wall parts.

3. Apparatus according to claim 1 wherein the cavity defined by said first stator and said second stator each have major and minor axes in cross section, each minor axis being offset from the median point of its major axis.

4. Apparatus according to claim 3 wherein the major and minor axes of said cavity lie substantially coincident with the major and minor axes of said second stator, the intersection of said major and minor axes lying substantially coincident with said axis of rotation.

5. Apparatus according to claim 1 wherein the surfaces defining the inner wall of said first stator and the outer wall of said second stator are each in part substantially semicircular in cross section, said rotor being substantially concentric with said semicircular inner and outer wall parts, the cavity defined by said first stator and said second stator each having major and minor axes in cross section, each minor axis being offset from the median point of its major axis, the major and minor axes of said cavity lying substantially coincident with the major and minor axes of said second stator, the intersection of said major and minor axes lying substantially coincident with said axis of rotation.

6. Apparatus according to claim 1 wherein the cavity defined by said first stator and said second stator each have major and minor axes in cross section, each minor axis being offset from the median point of its major axis, the remaining surfaces defining the inner wall of said first stator and the outer wall of said second stator being each in part substantially semi-ellipsoidal with major and minor axes, each said minor axis intersecting said major axis substantially coincident with the axis of rotation of said rotor.

7. Apparatus according to claim 1 wherein the inlet to and outlet from said second chamber are carried by said second stator.

8. Refrigeration apparatus comprising a first stator having an inner wall defining a cavity, a second stator within said cavity and having an outer wall spaced from the inner wall of said first stator, one of said cavity and said second stator being non-circular in cross section, a rotor including a sleeve within said cavity and rotatable about a fixed axis, said rotor defining first and second chambers within said cavity between said sleeve and the inner wall of said first stator and adjacent opposite sides of said cavity, said rotor defining third and fourth chambers within said cavity between said sleeve and the outer wall of said second stator and on opposite sides of said second stator, said sleeve having a plurality of circumferentially spaced slots, a plurality of vanes carried by said rotor for sliding movement in said slots along respective radii of said sleeve, said vanes being substantially equal in length between their respective radially inner and outer edges, the inner and outer walls of said first and second stators respectively being spaced one from the other such that the linear distance therebetween along any radius from said axis of rotation is substantially equal to the length of said vanes, said vanes being slidable radially, upon rotation of said rotor, whereby the outer and inner edges of said vanes are maintained in substantially continuous engagement with the walls of the first and second stators respectively, an inlet carried by said apparatus for delivering air into said third chamber, an outlet carried by said apparatus in communication with said third chamber, said vanes forming with said sleeve and said second stator a plurality of variable volume working chambers within said third chamber for compressing air delivered thereto and delivering such compressed air to said outlet upon rotation of said rotor, means connected to said outlet for cooling the compressed air received from said third chamber, an inlet connected to said cooling means for admitting the cooled air therefrom into said first chamber, an outlet carried by said apparatus in communication with said first chamber, said vanes forming with said sleeve and the inner wall of said first stator a plurality of variable volume working chambers within said first chamber for expanding and cooling air admitted thereto and delivering such expanded and cooled air through the latter mentioned outlet upon rotation of said rotor, an inlet carried by said apparatus for delivering air into said fourth chamber, an outlet carried by said apparatus in communication with said fourth chamber, said vanes forming with said sleeve and said second stator a plurality of variable volume working chambers within said fourth chamber for compressing air delivered thereto and delivering such compressed air to the latter mentioned outlet upon rotation of said rotor, said cooling means lying in communication with the latter mentioned outlet for cooling the compressed air received from said fourth chamber, an inlet connected to said cooling means for admitting the cooled air therefrom into said second chamber, an outlet carried by said apparatus in communication with said second chamber, said vanes forming with sleeve and the inner wall of said first stator a plurality of variable volume working chambers within said second chamber for expanding and cooling air admitted thereto and delivering such expanded and cooled air through the latter mentioned outlet upon rotation of said rotor.

9. Apparatus according to claim 8 wherein the major and minor axes of said cavity lie coincident with the major and minor axes of said second stator, the intersection of said major and minor axes lying coincident with said axis of rotation.

10. Apparatus according to claim 9 wherein said first and second chambers lie on opposite sides of said minor axes, said third and fourth chambers lying on opposite sides of said major axes.

11. Apparatus according to claim 8 wherein the inlets to and outlets from said third and fourth chambers are carried by said second stator.

* * * * *

UNITED STATES PATENT AND TRADEMARK OFFICE

CERTIFICATE OF CORRECTION

PATENT NO. : 4,015,441

DATED : 5 April 1977

INVENTOR(S) : SYLVIA J. ROBINET

It is certified that error appears in the above-identified patent and that said Letters Patent are hereby corrected as shown below:

Claim 8, column 2, line 46, insert --said-- before "sleeve".

Signed and Sealed this

Thirty-first Day of May 1977

[SEAL]

*Attest:*

RUTH C. MASON
*Attesting Officer*

C. MARSHALL DANN
*Commissioner of Patents and Trademarks*